United States Patent [19]

Tune

[11] Patent Number: 4,966,517

[45] Date of Patent: Oct. 30, 1990

[54] APPARATUS FOR ROTATING A VEHICLE THROUGH NINETY DEGREES

[76] Inventor: Shearer E. Tune, 3237 Estes, Memphis, Tenn. 38115

[21] Appl. No.: 340,021

[22] Filed: Apr. 18, 1989

[51] Int. Cl.[5] ..... B63C 3/00

[52] U.S. Cl. ..... 414/678; 212/180; 212/246; 254/3 B; 254/89 H

[58] Field of Search ..... 414/678, 577, 580, 362, 414/778; 187/8.41, 8.43, 8.5, 8.52, 8.67; 212/271, 246, 180, 181; 254/3 R, 3 B, 89 H

[56] References Cited

U.S. PATENT DOCUMENTS

| | | | |
|---|---|---|---|
| 1,915,024 | 6/1933 | Logette et al. | 187/8.43 |
| 2,567,672 | 9/1951 | Lawless | 414/678 |
| 3,428,191 | 2/1969 | Newswanger | 414/678 |
| 3,811,576 | 5/1974 | Fagen | 212/180 X |
| 3,818,579 | 6/1974 | Pietrelli et al. | 254/89 H X |
| 3,838,783 | 10/1974 | Tune | 414/577 |
| 4,031,982 | 6/1977 | Lindfars | 414/678 X |
| 4,134,501 | 1/1979 | Tune | 414/678 |
| 4,531,614 | 7/1985 | Naegeli | 254/89 H X |
| 4,700,851 | 10/1987 | Reeve et al. | 212/180 X |
| 4,724,930 | 2/1988 | VanLierop | 254/89 H X |

FOREIGN PATENT DOCUMENTS

| | | | |
|---|---|---|---|
| 0111388 | 8/1968 | Fed. Rep. of Germany | 254/3 R |
| 1531125 | 8/1969 | Fed. Rep. of Germany | 187/8.41 |

*Primary Examiner*—Robert J. Spar
*Assistant Examiner*—William M. Hienz
*Attorney, Agent, or Firm*—Berman, Aisenberg & Platt

[57] ABSTRACT

An apparatus is designed to rotate a vehicle by ninety degrees for repair of the under carriage of the vehicle and other parts accessible from the bottom. The preferred vehicle is a forklift, and a mast support is provided to be secured to the mast of the forklift. Wheel supports are provided which may be rotated out of engagement with the wheels when the vehicle is vertical to allow unobstructed access to the vehicle. Removable support bars may be used in place of the wheel supports to engage the bottom of the vehicle during rotation. The apparatus sits on a flat floor and does not require approach ramps or the like. The apparatus may be moved to any location and is symmetrical so that it may be placed against a wall on the left or right by a simple interchange of parts. A jib is provided which may be used to hoist heavy parts of the vehicle.

20 Claims, 11 Drawing Sheets

APPARATUS FOR ROTATING A VEHICLE THROUGH NINETY DEGREES

TECHNICAL FIELD

This invention relates to the art of repair equipment. In particular, the invention is a device for rotating a vehicle, preferably an electric fork lift, through 90° to facilitate repair of the fork lift.

BACKGROUND OF THE INVENTION

Various devices are known for moving a vehicle into a position which facilitates its repair. For example, it is known to raise a vehicle by driving it onto a platform which is vertically movable. This allows the repair personnel easy access to the bottom of the vehicle. Examples of such lifts are shown in U.S. Pat. No. 3,117,652 (Wallace); U.S. Pat. No. 3,265,357 (Schilling); U.S. Pat. No. 3,536,161 (Clarke); U.S. Pat. No. 2,222,111 (McCarthy); and U.S. Pat. No. 1,936,107 (Cunneen).

These lifts are inconvenient, particularly when it is necessary to remove a heavy object from the vehicle. For example, if a motor other heavy object is to be removed from the bottom of the vehicle, it is necessary to provide a vertical stand or support to carry the object. Further, is difficult to work on a vehicle in such an orientation because the mechanic must perform work above his head.

My prior patents (U.S. Pat. Nos. 3,838,783 and 4,134,501) show devices for rotating a vehicle through an angle to allow repair of the vehicle. The devices shown in these patents do not provide for the vehicle to be rotated through ninety degrees and do not adequately facilitate repair of the undercarriage of the vehicle. Moreover, the structures used in these devices require the vehicle to be driven up onto a movable platform, which results in increased construction expense.

SUMMARY OF THE INVENTION

In accordance with the invention, an apparatus is provided which rotates a vehicle to be repaired through a 90° angle. The bottom of the vehicle thus rotated is fully exposed whereby the mechanic may easily work on the various parts of the vehicle quite easily.

The apparatus includes a base frame which is adapted to be placed on level surface, such as a concrete pad. A stabilizing bar is pivotally attached to the base frame, and wheel supports are provided on the stabilizing bar for engaging the wheels of the vehicle. A mast support is fixed to the stabilizing bar for engaging the front of the vehicle. If the vehicle is a known fork lift, the mast support engages the fork lift mast. A hydraulic cylinder is attached to the front of the base frame and to the mast support for pivoting the mast support and stabilizing bar to rotate the vehicle by 90°. A lifting bar is secured between the mast support and the stabilizing bar for providing additional strength and for receiving a hold down bar which secures the vehicle to stabilizing bar.

When rotated to a 90° orientation, the weight of the vehicle is received by the mast, and the wheel support plates may be pivoted away from the wheels to allow access to the wheels and to the structure around the wheels. The wheel support plate located at the end of the stabilizing bar has a service hole and swings outwardly to support a chain hoist for lifting heavy articles in the repair of the vehicle.

In an alternative arrangement, the wheel supports are replaced by a support bar which engages the frame of the vehicle. The support bar is removable from the stabilizing bar and is removed when the vehicle is vertical to permit access to the bottom of the vehicle.

In addition, a jib crane may be secured to the base frame to support a chain or cable hoist, or the like, for supporting heavy objects which are to be removed or replaced.

If it is desired to use the apparatus of the invention to repair a vehicle known as a narrow-aisle fork lift, a support bar is provided for extending between the mast support and the fork lift mast, as will be more apparent from the detailed description given below.

The wheel support plates are preferably driven by hydraulic cylinders and include hydraulically controlled safety latches to insure that the lift support plates are in the proper position when the vehicle is being rotated.

In the preferred embodiment, the jib crane is capable of being attached to either side of the apparatus whereby it may be placed against a wall on either side to conserve floor space.

DETAILED DESCRIPTION OF THE PREFERRED EMBODIMENT

Figure 1:
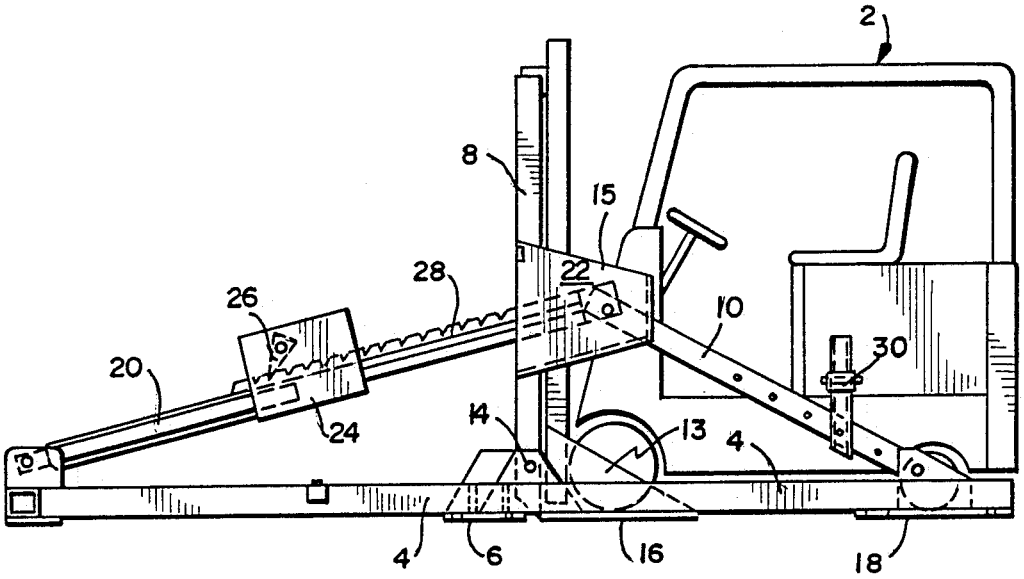
FIG. 1 is a side view of an apparatus in accordance with the invention showing a fork lift in a horizontal position.

FIG. 1, is a side view of an apparatus in accordance with the invention for rotating a vehicle, such as a fork lift 2, through 90° for repair. The apparatus comprises a base frame 4 which is preferably rectangular and bolted to a concrete floor by anchor plates 6 (See FIG. 3).

Pivotally mounted to base frame 4 is a structure comprising a fork lift mast support 8, a lifting bar 10, and a stabilizing bar 12. The mast support and the stabilizing bar are connected by gusset plate 13 and are connected to base frame 4 at pivot pins 14. Front wheel support plates 16 and rear wheel support plate 18 are attached to parallel stabilizer bars 12 to engage the wheels of the fork lift 2 and are capable of pivoting away from the wheels in a manner which will be explained in more detail below.

It will be seen that the wheel support plates rest on the floor and that no approach ramps are required. This simple construction permits the apparatus to be placed in any of a variety of locations and easily moved between locations.

Figure 2:
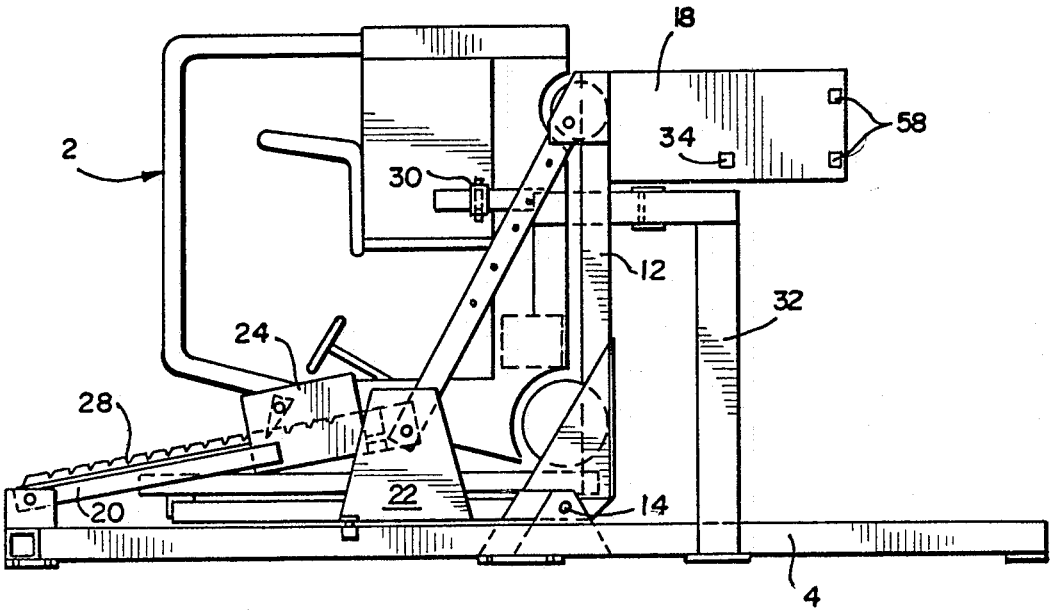
FIG. 2 is a side view of an apparatus in accordance with the invention showing the fork lift in a vertical position and a jib crane operatively attached to the base frame.

Hydraulic cylinders 20 are attached between the front of base frame 4 and a gusset plate 22 which is secured to fork lift mast support 8 and lifting bar 10. Activation of hydraulic cylinders 20 pivots fork lift mast support 8, lifting bar 10, and stabilizing bar 12 about pivot 14 to rotate vehicle 2 into a 90° position as shown in FIG. 2. The hydraulic cylinders pull on the gusset plate 22 and could be replaced with a variety of devices which create the required linear force. For example, a screw drive system or a winch system could be employed.

Safety boxes 24 include a pawl 26 which engages teeth on a safety rack 28 to prevent rotation of vehicle 2 in an undesired direction upon failure of the hydraulic cylinders 20. A similar safety system is shown more fully in my U.S. Pat. No. 4,134,501. It should be noted, however, that the rack in the present arrangement operates in tension, whereas the earlier system operated in compression. By operating the system in tension, there is less possibility that the safety rack will buckle, and lighter parts may be used, resulting in less expense.

Vehicle 2 is secured to lifting bar 10 during the lifting operation by a hold down bar 30. Hold down bar 30 extends transversely across the vehicle 2 and engages lifting bar 10 at its opposite ends. Hold down bar 30 will be described in more detail below.

FIG. 2 shows a vehicle 2 in a vertical position and shows a jib crane 32 secured to base frame 4 in an operative position. Jib crane 32 will be described in more detail below. In addition to use of jib crane 32 to support heavy objects being removed from or installed into vehicle 2, the rear wheel support plate 18 may be pivoted outward as shown in FIG. 2 also to act as a crane. For example, a hole 34 provides a place for attaching a chain hoist, or the like. Rear wheel support plate 18 is mounted for rotation with respect to stabilizing bars 12 in a manner which will be described in more detail below.

Figure 3:
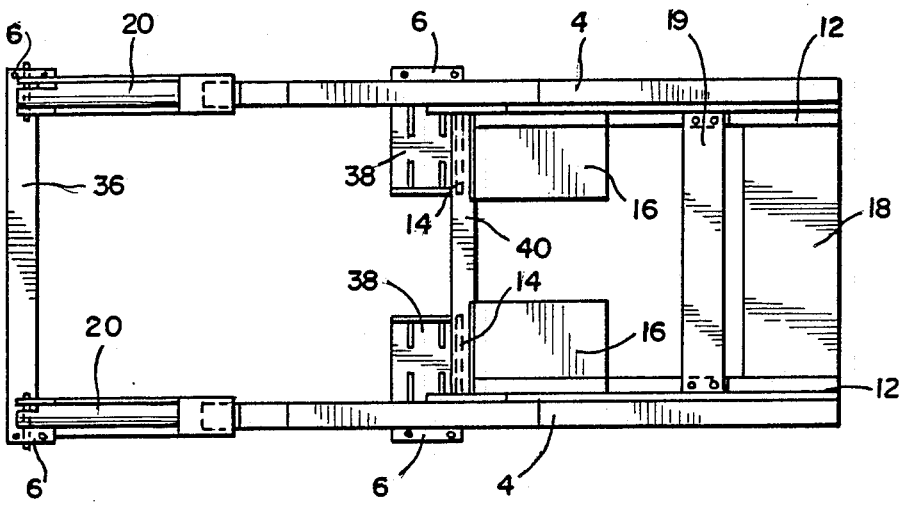
FIG. 3 is a top view of an apparatus in accordance with the invention.

With reference to FIG. 3, base frame 4 includes a cross tube 36 to provide additional strength, and base plates 38 are located adjacent the pivot pins to provide additional support and to permit the apparatus to be bolted to the floor.

Other mechanisms may be used to engage the front and rear wheels. For example, the rear wheel support plate 18 may be replaced by a support bar 19 and front wheel support plates 16 retained. Alternatively, all wheel support plates may be replaced by two or more support bars such as support bar 19. The support bar 19 is preferably bolted to the stabilizing bar such that it may easily be removed when the vehicle is in a vertical orientation to provide access to the undercarriage of the vehicle.

Figure 3A:
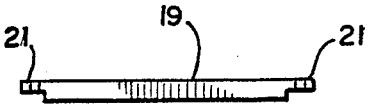
FIG. 3*a* is a side view of a support bar.

FIG. 3*a* is a side view of a support bar 19. The bar includes an upper surface which is designed to engage the bottom surface of the vehicle. If the vehicle is a forklift, the bars would engage its frame immediately adjacent the wheels. Tabs 21 rest on the top of the stabilizing bar and have holes therein for receiving bolts for securing the support bar to the stabilizing bar.

Figure 4:
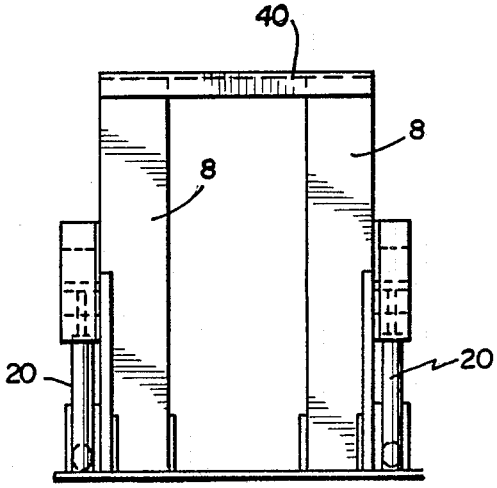
FIG. 4 is a front view of an apparatus in accordance with the invention.

FIG. 4 is a front view of the apparatus and illustrates the preferred structure of the fork lift mast support 8, the upper ends of which are connected by a support cross bar 40 for additional strength.

Figure 5:
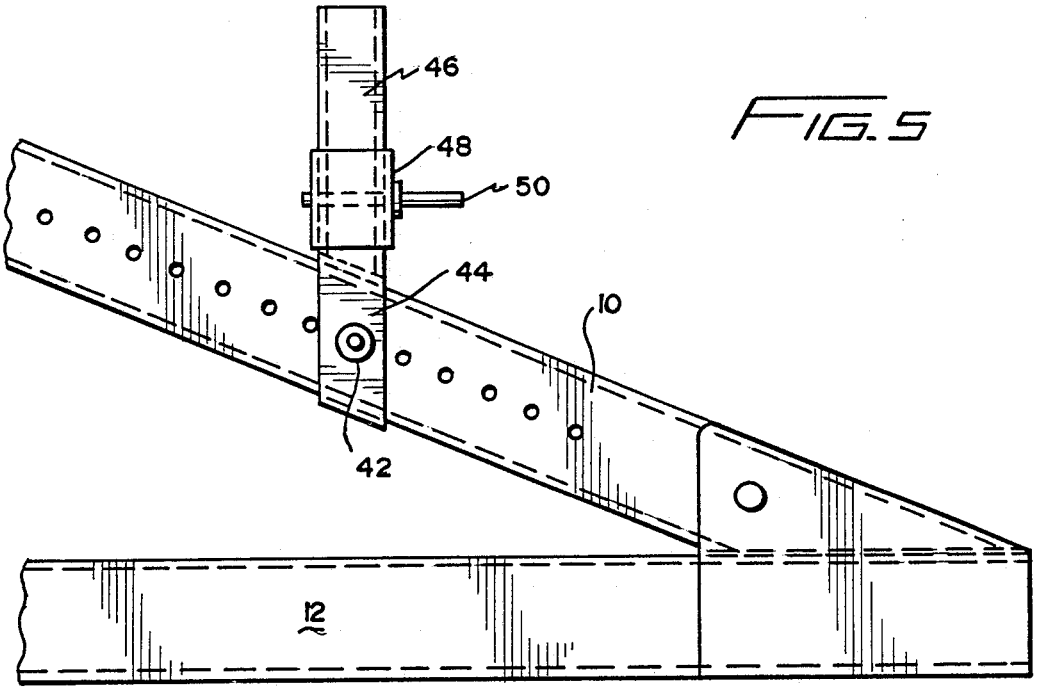
FIG. 5 is a partial side view of one end of an apparatus in accordance with the invention.
Figure 6:
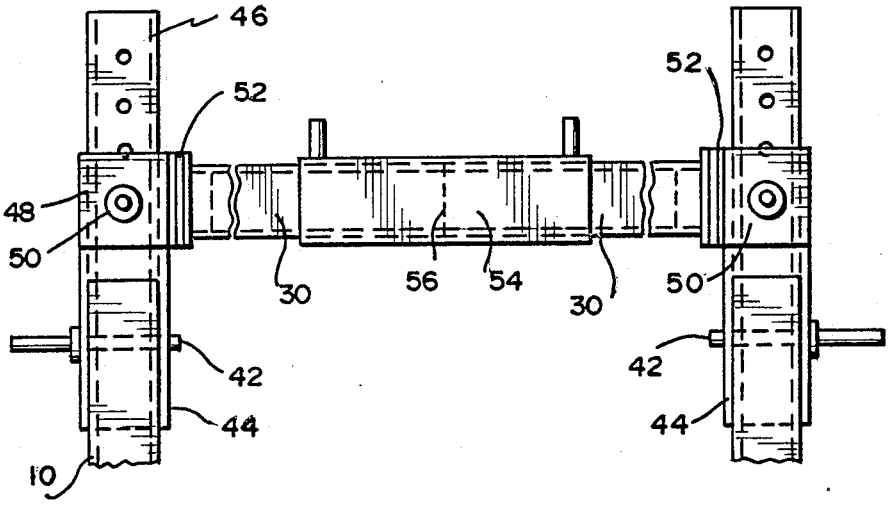
FIG. 6 is an end view of a hold down bar portion of an apparatus in accordance with the invention.

FIGS. 5 and 6 illustrate the hold down bar 30 and its associated structure in greater detail. Lifting bar 10 has a plurality of holes spaced by predetermined distances for receiving a pin 42 which passes through the holes and a bracket 44. The bracket slides along the lifting bar 10 for adjusting its height with respect to the stabilizing bar 12. Attached to bracket 44 is a vertical adjusting bar 46 which receives a sliding bracket 48 of hold down bar 30. A second adjusting pin 50 passes through holes in vertical adjusting bar 46 and bracket 48 and allows the vertical position of hold down bar 30 to be adjusted. Thus, bracket 44 allows the horizontal position of the hold down bar to be adjusted, while bracket 48 allows the vertical position to be adjusted. Hold down bar 30 comprises two parts, each of which is connected to a respective vertical sliding bracket 48 by a hinge 52. A lock tube 54 may be slid along the hold down bar 30 to expose a joint 56 between the two parts of the hold down bar 30. When the lock tube is slid along the lock bar to such a position that joint 56 is exposed, the two parts of the hold down 30 may be pivoted about an axis defined by hinges 52 to allow the hold down bar to be pivoted out of the way to permit the fork lift to be moved into place or moved from the tilting apparatus.

If the vehicle is to be repaired, it is driven onto the apparatus such that the wheels engage support plates 16 and 18, and the two parts of the hold bar 30 are rotated into position. The lock tube 54 is in slid along the hold down bar such that joint 56 is covered. The location of the hold bar 30 is adjusted by placing the adjusting pins 42 and 50 in appropriate holes in the lifting bar 10 or the vertical adjusting bar 46. In a known gasoline powered lift, the hold down bar 30 would pass in front of the seat, while in a known electric vertical lift, the hold down bar would pass across the battery compartment. Because of the adjustability of the location of the hold down bar 30, a variety of vehicles may be accommodated.

If the support bars 19 are used in place of the wheel supports, they would be installed to engage the vehicle's frame before the vehicle is rotated.

Figure 7:
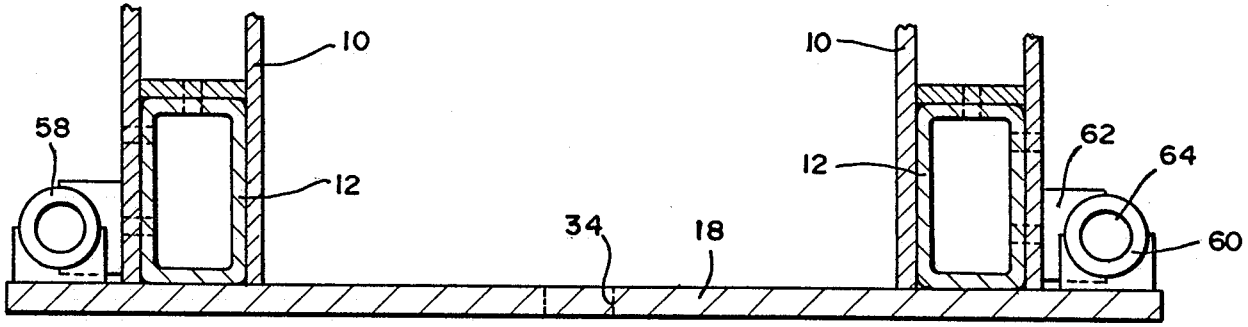
FIG. 7 is a cross section taken along line 7—7 of FIG. 8.
Figure 8C:
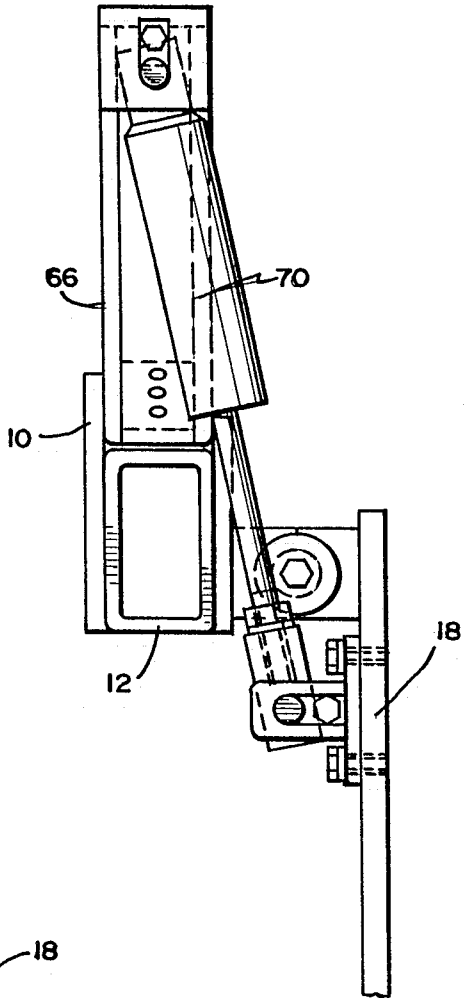
FIGS. 8*a*–8*c* are views of a mechanism for driving a rear wheel support plate between two positions.
Figure 8B:
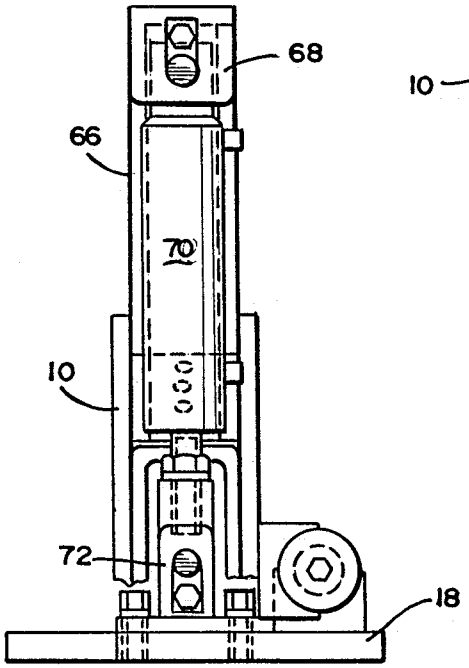
Figure 8A:
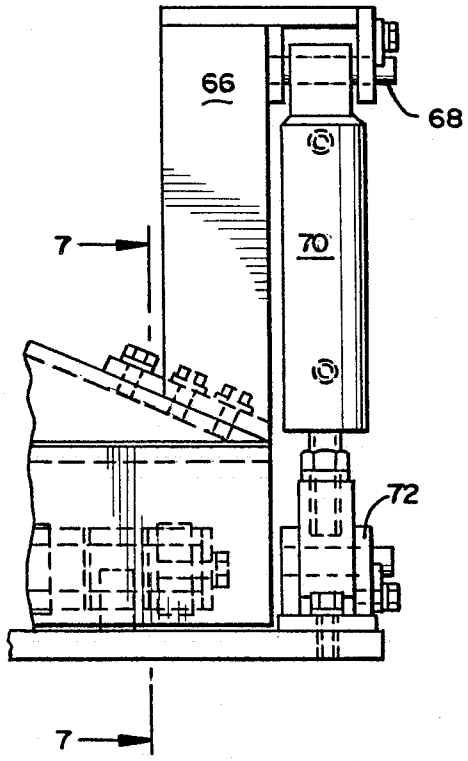

FIG. 7 is a cross section of the pivoting portion of the apparatus along line 7—7 of FIG. 8*a* and shows stabilizing bar 12, lifting bar 10, and rear wheel support plate 18 in a closed position. Opposite sides of the rear wheel support plate 18 include brackets 58 and 60. Bracket 58 receives locking pins which will be described more fully below, and bracket 60 receives a hinge pin for permitting the plate 18 to rotate outward as shown in FIG. 2. Brackets 58 and 60 are preferably identical such that either side of the plate may be used with the locking pins or the hinge pin. This permits the apparatus to be used in virtually any location because the elements may be interchanged from the left to the right side. A bracket 62 supports a hinge pin 64, and bracket 62 is preferably bolted to stabilizing bar 12 to allow it to be removed and placed on the other side.

FIGS. 8*a*–8*c* shows an embodiment wherein a hydraulic cylinder is mounted to the ends of the lifting bar 10 and stabilizing bar 12. A bracket 66 is bolted to the top of lifting bar 10 by three bolts (not numbered). Bracket 66 includes a mounting shaft 68 which supports the top of a hydraulic cylinder 70 which allows support plate 18 to pivot about hinge 64 to expose the undercarriage of the vehicle on the lift. Hydraulic cylinder 70 is attached to a bracket 72 on one side of the rear wheel support plate 18. After rear support plate 18 has been released, as will described below, cylinder 70 may be operated to drive the rear wheel support plate 18 to the position shown in FIG. 8*c*, and cylinder 70 may then be activated to return the rear support plate 18 to the position shown in FIG. 8*b* for latching.

Figure 9A:
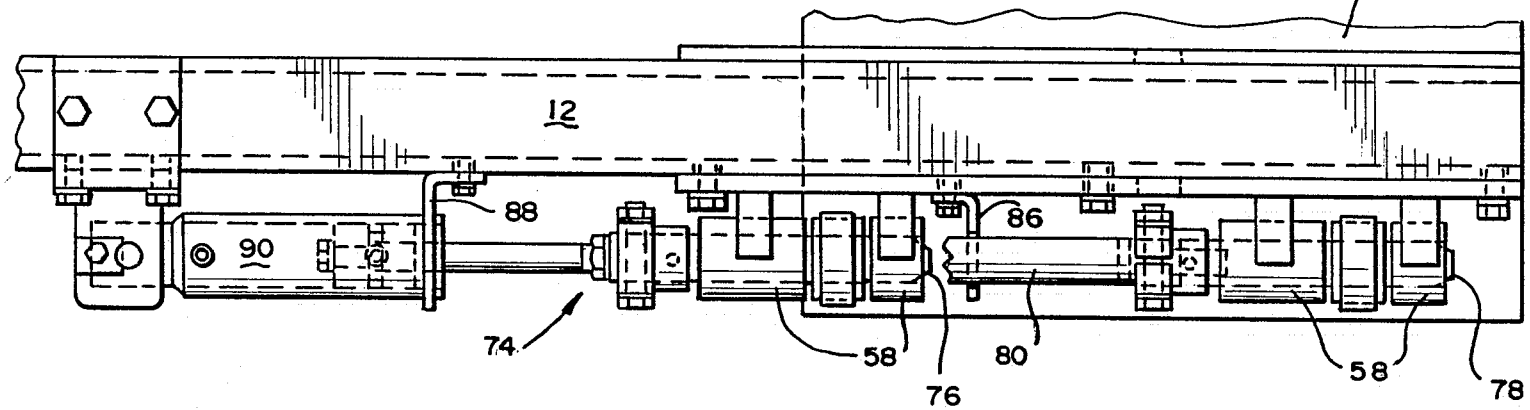
FIGS. 9*a*–9*c* are views of a mechanism for locking the rear wheel support plate in one position.
Figure 9B:
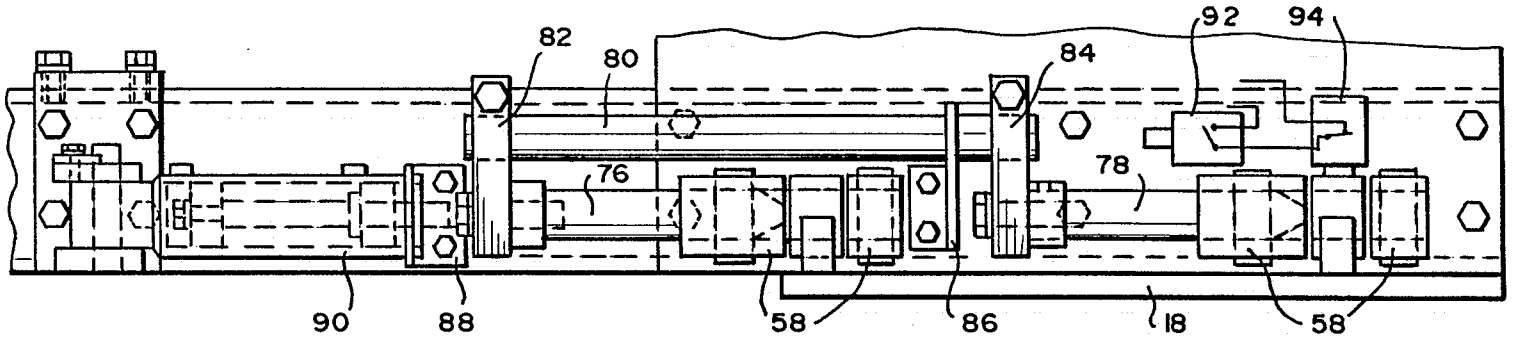
Figure 9C:
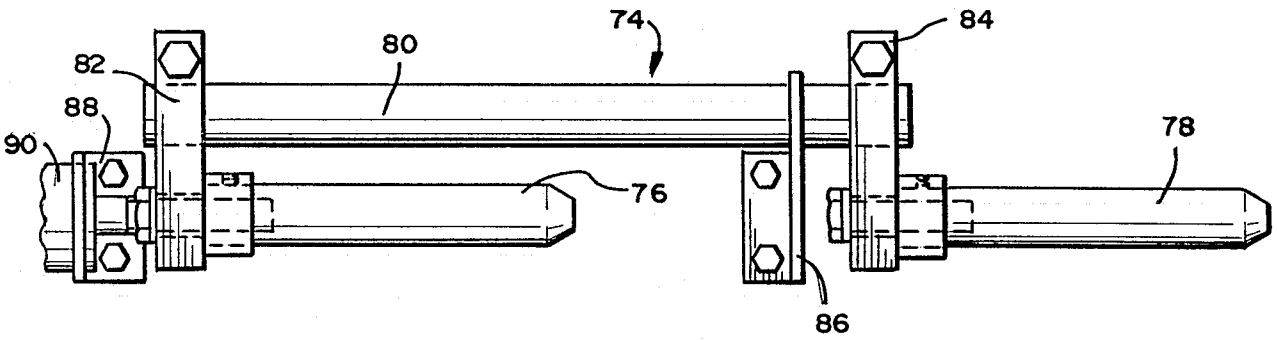

FIG. 9*a* is a partial top view of stabilizing bar 12, brackets 58 and a locking pin assembly 74. FIG. 9*b* is a side view of the structure shown in FIG. 9*a*, and FIG. 9*c* is a side view of locking pin assembly 74 showing locking pins 76 and 78 connected by a push rod 80. Locking pins 76 and 78 are secured to push rod 80 by brackets 82 and 84, and push rod 80 is slid in a bracket 86 which is bolted to the stabilizing bar 12. A second bracket 88 is similarly bolted to stabilizing bar 12, and supports a hydraulic cylinder 90. Hydraulic cylinder 90 operates to move locking pin assembly 74 reciprocally. When moved forwardly, pins 76 and 78 are urged into pin bracket 58 as shown in FIG. 9*a* to lock the rear support 18 to prevent its being pivoted outwardly as shown in FIG. 8*c*.

Electronic switches 92 and 94 (FIG. 9*b*) provide a safety feature. Switch 94 is closed when plate 18 is in the position to be locked, and sensing by an electronic circuit that this switch is closed allows the hydraulic cylinder 90 to be activated. When locking pin assembly 74 is advanced fully, push rod 80 engages switch 92, closing that switch. When switches 92 and 94 are closed, the stabilizing bar and lifting bar combination may be lowered to place the vehicle into a horizontal orientation. If these switches are not closed, the electronic safety circuit will not allow activation of the other systems to cause the vehicle to be lowered.

While mechanical switches are illustrated in the drawings, other devices for sensing the position of the parts may be used. For example, proximity switches may be substituted for those shown in the drawings.

Figure 10B:
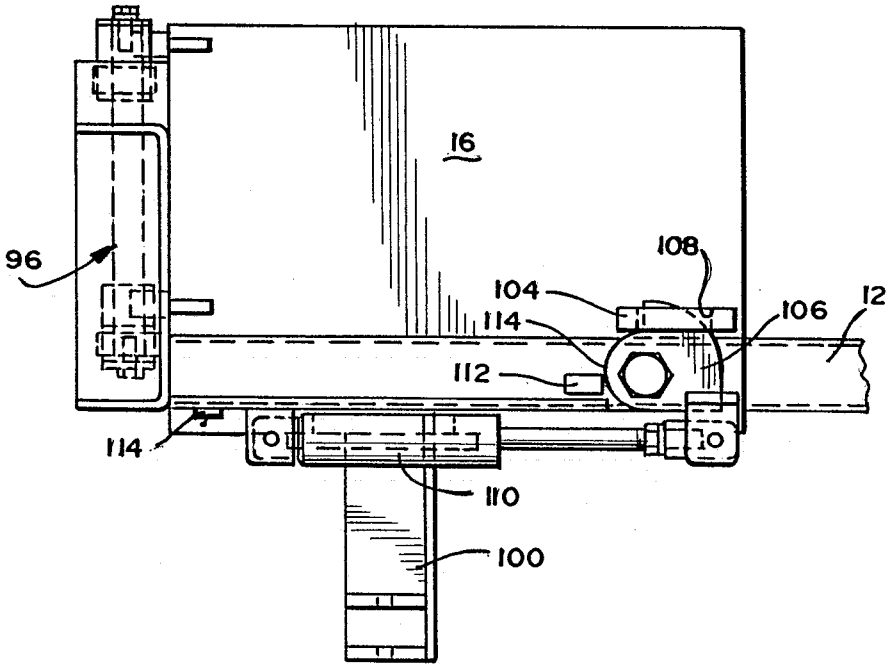
FIGS. 10*a*–10*c* show a mechanism for moving front wheel support plates between two positions and for locking them in one position.
Figure 10A:
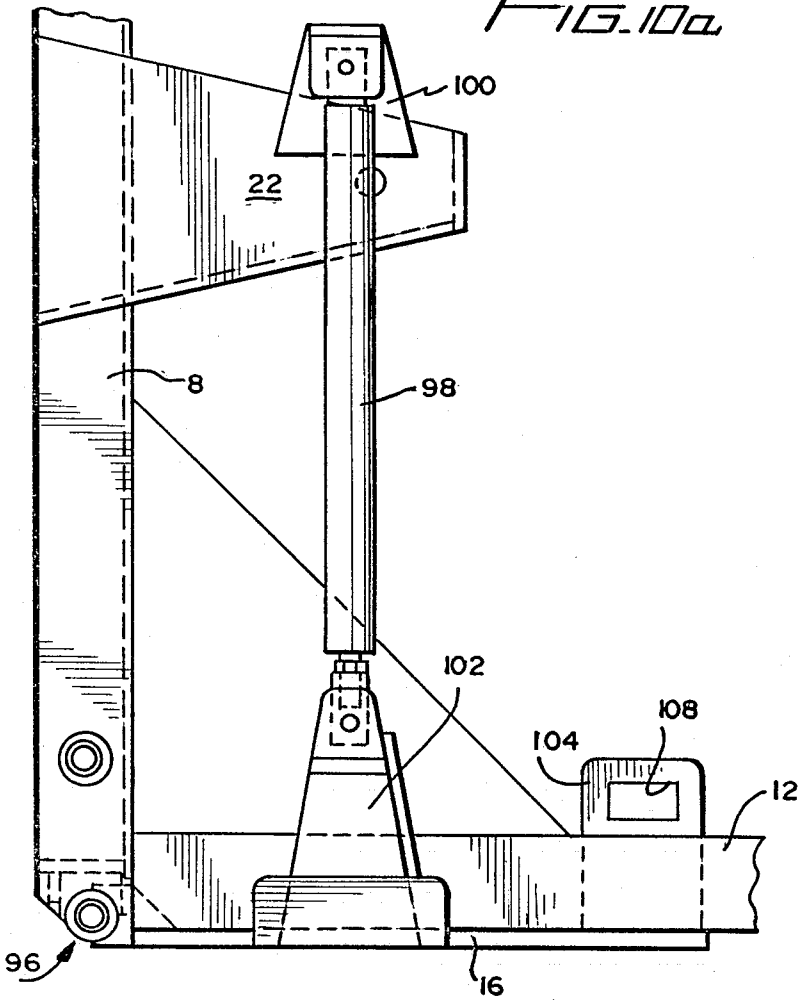

FIG. 10*a* is a side view of a preferred mechanism for rotating front wheel support plates 16 away from the wheel when the vehicle is vertical. Preferably, the front wheel receiving plates 16 are attached to the intersection of the stabilizing bar 12 and the mast support 8 by a hinge 96. A hydraulic cylinder 98 is mounted to gusset plate 22 by a bracket 100 and to a front wheel receiving plate 16 by a bracket 102. Activation of hydraulic cylinder 98 rotates front wheel receiving plate 16 toward or away from stabilizing bar 12. A latch plate 104 is welded to the wheel receiving plate 16 for receiving a latching mechanism as shown in FIG. 10*b*.

FIG. 10*b* is a top view of a front wheel support plate 16 showing rotating latch 106 engaged in hole 108 in latch plate 104. Rotating latch 106 is pivotally mounted to stabilizer bar 12 and is activated by hydraulic cylinder 110 which is mounted to stabilizer bar 12 at one end and to the rotating latch 106 at its opposite end. A switch 112 is mounted to stabilizer bar 12 and is activated by a trip lever 114 on rotating latch 106. Activation of switch 112 occurs at a predetermined position of the rotating latch 106. This allows the central electronic circuit of the system to detect when the front wheel receiving plates 16 are latched to enable hydraulic systems to raise or lower the vehicle.

Figure 10C:
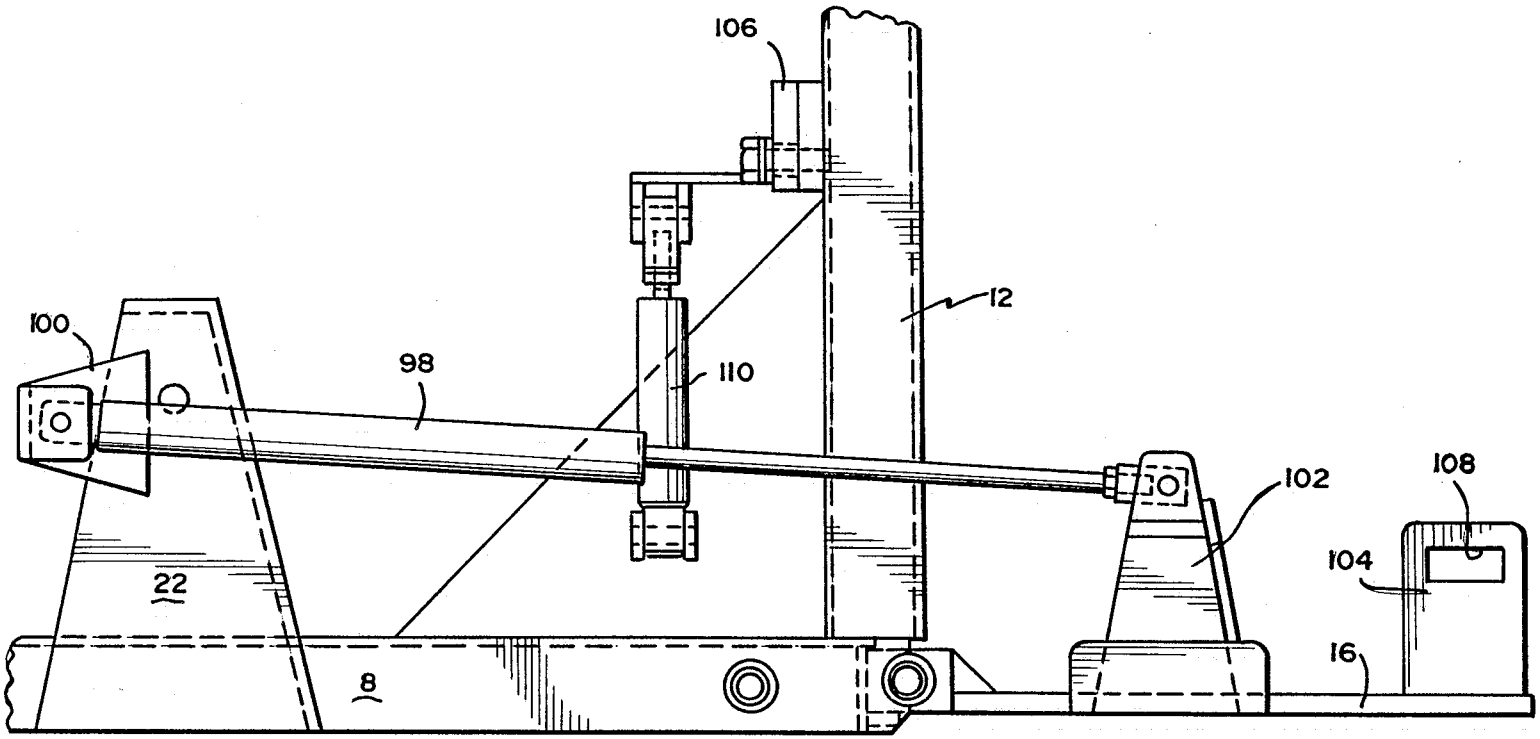

If the rear receiving plates are not latched, the hydraulic system will be disabled, preventing raising or lowering of the vehicle. Similarly, switch 114 senses the position of front wheel receiving plates 16 to enable or disable the hydraulic cylinder 20. FIG. 10*c* is a side view showing a front wheel receiving plate 16 rotated away from the stabilizer bar 12 when the vehicle is in the vertical position to allow access to the undercarriage of the vehicle.

Figures 11A, 11B:
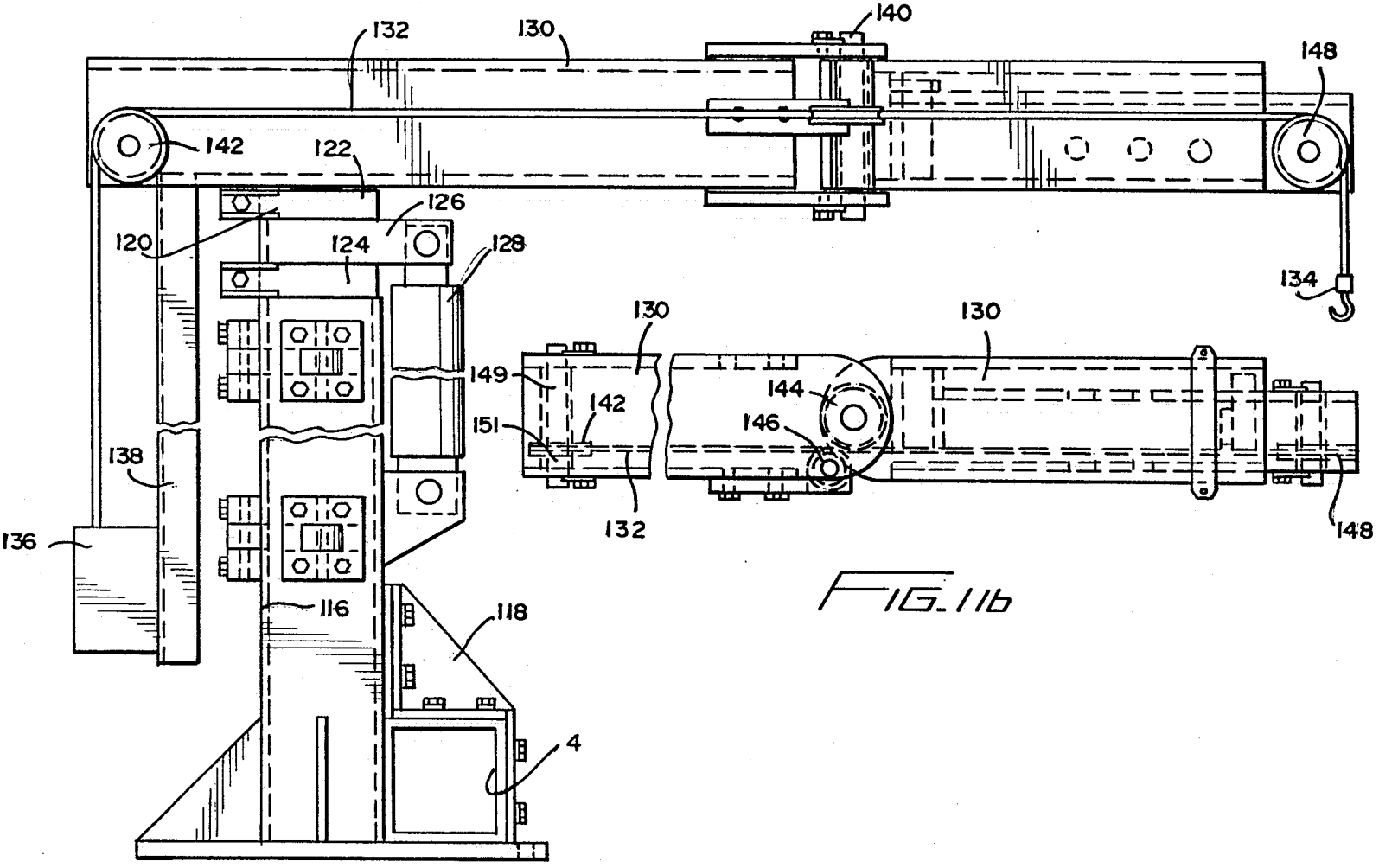
FIGS. 11*a* and 11*b* are side and top views of a jib crane for use with the tilting apparatus of the invention.

FIG. 11*a* is a side view of a jib for lifting heavy items from the vehicle undergoing repair. A first outer post 116 is mounted to base frame 4 by a bracket 118. The bracket and mounting arrangement are symmetrical so that the jib may be attached to either side of the base frame 4. Inner cylinder 120 is carried within outer cylinder 116 and has locking collars 122 and 124 secured thereto. A lifting collar 126 is located between locking collars 122 and 124, and lifting collar 126 is attached to hydraulic cylinder 128. A horizontal boom 130 is attached to inner cylinder 120 for being raised or lowered with it. Boom 130 is hollow and includes a space for receiving a cable 132 which has a hook 134 at a remote end and a hoist 136 at an opposite end for use in lifting items. Hoist 136 is attached to bracket 138, and a handle (not shown) may be attached to the bracket to provide additional leverage in rotating the boom 130. Boom 130 comprises two parts connected to each other by a hinge pin 140. This allows the outer portion of boom 130 to be rotated about the axis formed by pivot pin 140 to facilitate use of the apparatus. FIG. 11*b* is a top view of the boom 130 and illustrates the preferred method of guiding cable 132. A first pulley 142 is mounted at on end of boom 130 and receives cable 132 directly from the hoist. Second pulley 144, and third pulley 146 are mounted near the intersection of the two parts of the boom 130. Pulley 144 is mounted for rotation about an axis which is aligned with the axis of pivot 140, while pulley 146 is spaced slightly behind pivot 140 such that cable 132 is held between pulleys 144 and 146. A pulley 148 is located at one end of boom 130 for rotation about a horizontal axis. Pulleys 142, 146, and 148 are mounted on one side of the boom 130 to provide proper operation of pulley 144. If it is desired to mount the cable on the other side, pulleys 142 and 148 are moved to the other side of the boom to align with the other side of pulley 144 by interchanging the spacers such as at 149 and 151 which hold the pulleys in place.

Figure 12A:
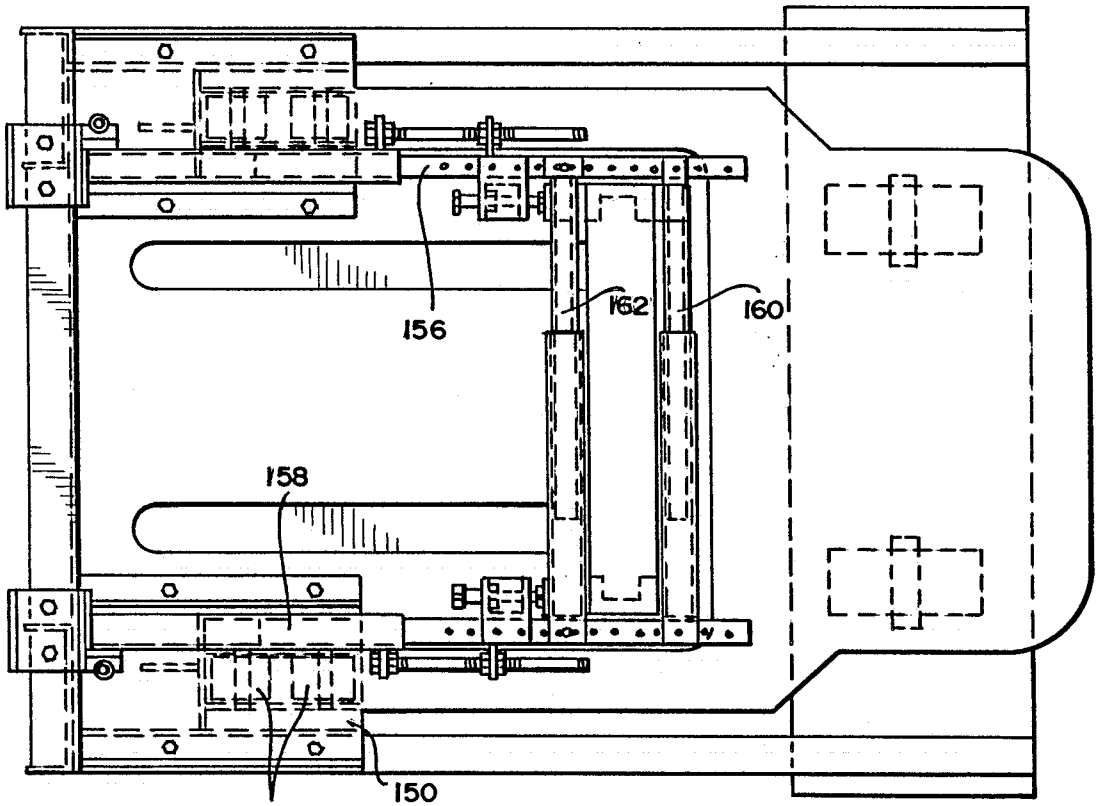
FIGS. 12*a* and 12*b* are top and side views of the apparatus of FIG. 1 modified to accept a narrow-aisle lift.
Figure 12B:
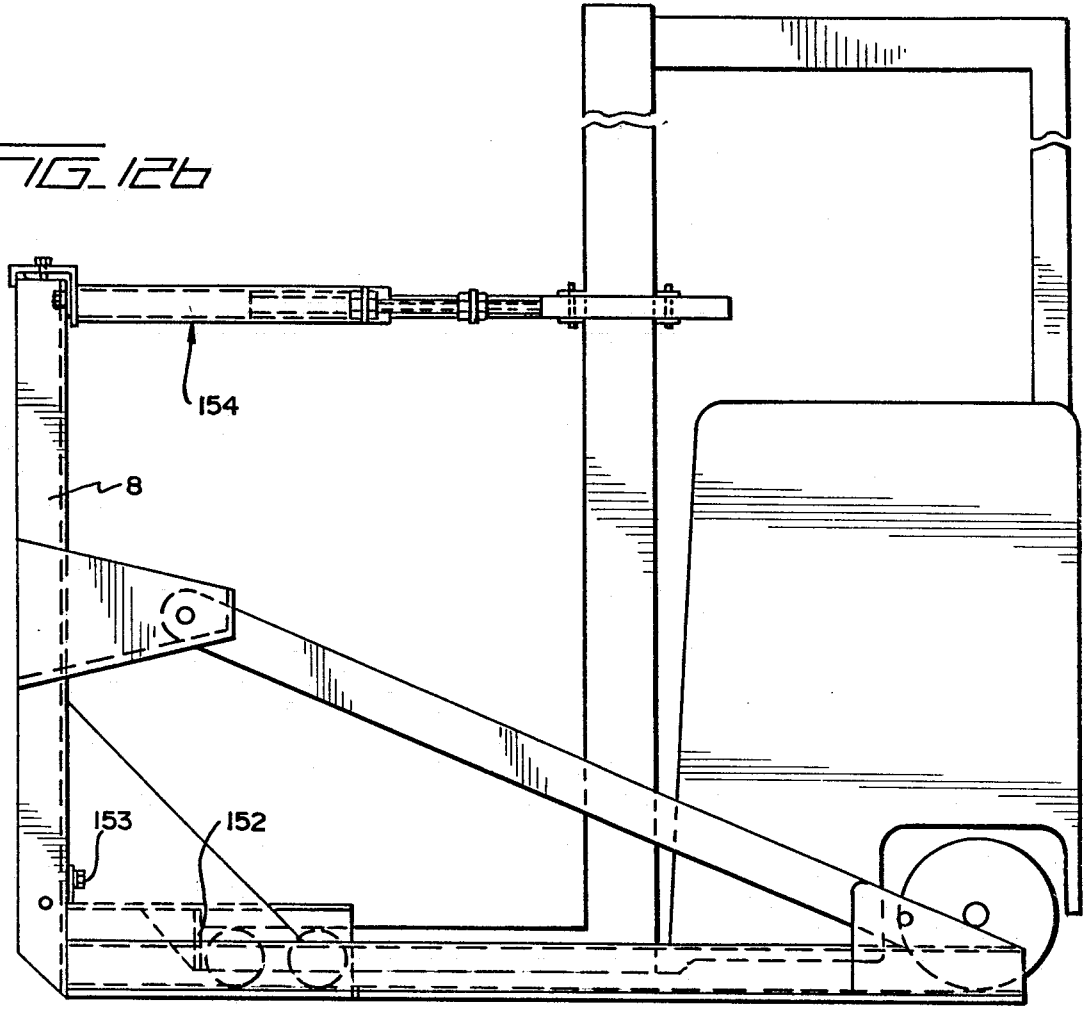

FIGS. 12*a* and 12*b* illustrate an attachment which permits the apparatus described above to be used on a lift known as a "narrow aisle fork lift". This fork lift is smaller than other fork lifts and uses front wheels closely adjacent the front of the fork. As shown in FIG. 12*a*, the smaller front wheels 155 may be accommodated by securing a pocket 150 to each of the front wheel support plates 16. The pocket provides a narrow channel for receiving the wheels, a narrow channel being formed by upstanding vertical walls, and a stop 152 (see FIG. 12*b*). The pocket may be secured by a bolt such as that shown at 153.

The mast of the narrow aisle fork lift is held to the mast support 8 by an adjustable arm 154. As shown in FIG. 12*a*, the adjustable arm includes parallel elements 156 and 158, and transverse, telescoping elements 160 and 162. The mast of the fork lift is secured between telescoping elements 160 and 162, and remote ends of the parallel elements 156 and 158.

The adjustable arm 154 may also be used to secure the forklift, either a narrow aisle or a standard size forklift, when it is backed into the apparatus. When a standard forklift has its rear end against the mast support 8, arm 154 may be extended the length of the forklift to engage the mast at the front of the lift. Thus, the forklift may be secured to the apparatus in either orientation.

Various safety switches may be used to control solenoid-operated valves to prevent operation of selected hydraulic cylinders if such operation would result in a dangerous movement of the apparatus. Similarly, the switches may be used to control the logic circuit which in turn controls the operations of the apparatus.

Modifications within the scope of the appended claims will be apparent to those skilled in the art.

I claim:

1. Apparatus for rotating a vehicle from a horizontal position to a vertical position and for permitting repairs to said vehicle comprising base frame means for being placed on a floor, stop means for engaging an end of said vehicle, support means for engaging a bottom surface of said vehicle during rotation, lifting means for rotating said stop means and said support means about a substantially horizontal axis with respect to said frame means and for rotating said vehicle to a vertical orientation, and means for allowing said support means to be moved away from and disengaged from said bottom surface while said vehicle is in said vertical orientation, for exposing the bottom of the vehicle whereby the bottom of said vehicle is substantially unobstructed.

2. Apparatus according to claim 1 wherein said support means is mounted to a stabilizing bar means and said lifting means is attached to said stabilizing bar means.

3. Apparatus according to claim 2 further comprising securing means for preventing movement of said vehicle with respect to said stabilizing bar means.

4. Apparatus according to claim 3 wherein said securing means comprises a hold down bar for extending across said vehicle, said bar comprising vertically adjustable bracket means.

5. Apparatus according to claim 4 wherein said lifting means comprises lifting bar means extending at an angle to said stabilizing bar means and wherein said vertically adjustable bracket means is attached to said lifting bar means.

6. Apparatus according to claim 1 further comprising jib means for attachment to said base frame means for supporting removed parts of said vehicle.

7. Apparatus according to claim 6 wherein said jib means comprises first and second parts pivotally connected to each other for rotation about a pivotal axis, cable means for lifting objects, and pulley means for guiding said cable means in said first and second parts, wherein said pulley means comprises a first pulley having an axis of rotation aligned with said pivotal axis.

8. Apparatus according to claim 7 wherein said pulley means comprises a second pulley mounted for rotation about an axis of rotation transverse to said pivotal axis and further comprising first and second spacer means for holding said second pulley in a predetermined position with respect to said first or second parts such that said cable means is aligned with a first side of said first pulley, said first and second spacer means being interchangeable for aligning said cable means with an opposite side of said first pulley.

9. Apparatus according to claim 1 wherein said support means comprises a plate pivotally mounted to a stabilizing bar means for engaging wheels of said vehicle, and said lifting means is attached to said stabilizing bar means.

10. Apparatus according to claim 9 further comprising safety means comprising means for preventing rotation of said support means when said support means is in an orientation corresponding to a nonvertical position of said vehicle.

11. Apparatus according to claim 2 further comprising safety means for preventing disengagement of said support means from said bottom surface when said support means is in an orientation corresponding to a nonvertical position of said vehicle.

12. Apparatus according to claim 11 wherein said safety means further comprises switch means for sensing the position of said support means and for disabling said lifting means.

13. Apparatus according to claim 1 wherein said lifting means comprises means for applying a linear force between said frame means and said stop means.

14. Apparatus according to claim 13 further comprising safety means for retaining a predetermined relationship between said frame means, said stop means, and said support means in response to a safety signal.

15. Apparatus according to claim 14 wherein said lifting means comprises variable length means for varying the distance between said frame means and said stop means and said safety means comprises means for maintaining a fixed distance of said variable length means.

16. Apparatus according to claim 15 wherein said means for maintaining a fixed distance is in tension when maintaining said fixed distance.

17. Apparatus according to claim 15 wherein said variable length means comprises an hydraulic cylinder.

18. Apparatus according to claim 1 further wherein said stop means comprises means for engaging the mast of a forklift and further comprising means for securing said mast to said stop means.

19. Apparatus according to claim 18 wherein said means for securing said mast to said stop means comprises means for extending the length of said forklift and for securing said mast to said stop means when the rear of said forklift engages said stop means.

20. Apparatus according to claim 2 wherein said support means comprises a support bar removably attached to said stabilizing bar.

* * * * *